US007789348B2

(12) United States Patent
Ruggiero et al.

(10) Patent No.: US 7,789,348 B2
(45) Date of Patent: Sep. 7, 2010

(54) METHODS AND SYSTEMS FOR VERIFYING THE OPERATION OF A RAILROAD GATE

(75) Inventors: Andrew Lawrence Ruggiero, Lee Summit, MO (US); John Charles Hounschell, 2nd, Grain Valley, MO (US); Mark J. Bartonek, Blue Springs, MO (US)

(73) Assignee: General Electric Company, Schenectady, NY (US)

( * ) Notice: Subject to any disclaimer, the term of this patent is extended or adjusted under 35 U.S.C. 154(b) by 630 days.

(21) Appl. No.: 11/757,708

(22) Filed: Jun. 4, 2007

(65) Prior Publication Data

US 2008/0296442 A1 Dec. 4, 2008

(51) Int. Cl.
*B61L 23/00* (2006.01)

(52) U.S. Cl. ..... 246/111

(58) Field of Classification Search ..... 246/1 R, 246/1 C, 111–114 R, 218, 221
See application file for complete search history.

(56) References Cited

U.S. PATENT DOCUMENTS

| | | | | |
|---|---|---|---|---|
| 4,666,108 | A | 5/1987 | Fox | |
| 5,834,914 | A | 11/1998 | Moe et al. | |
| 5,954,299 | A | 9/1999 | Pace | |
| 6,158,696 | A | 12/2000 | Brodskiy | |
| 6,307,339 | B1 * | 10/2001 | Yourist et al. | 318/266 |
| 6,470,626 | B2 | 10/2002 | Luetzow et al. | |
| 6,618,993 | B2 * | 9/2003 | Burke | 49/49 |
| 6,688,561 | B2 | 2/2004 | Mollet et al. | |
| 6,776,377 | B1 | 8/2004 | Watkins | |
| 7,075,427 | B1 | 7/2006 | Pace et al. | |
| 7,154,403 | B2 | 12/2006 | Davenport et al. | |
| 7,195,211 | B2 | 3/2007 | Kande et al. | |
| 2003/0122039 | A1 | 7/2003 | Mollet et al. | |
| 2006/0001547 | A1 | 1/2006 | Davenport et al. | |

OTHER PUBLICATIONS

European Search Report, EP08157305, dated Aug. 3, 2009, pp. 7.

* cited by examiner

*Primary Examiner*—S. Joseph Morano
*Assistant Examiner*—Robert J McCarry, Jr.
(74) *Attorney, Agent, or Firm*—John A. Kramer, Esq.; Armstrong Teasdale LLP

(57) ABSTRACT

A system for verifying the operation of a railroad gate is provided. The system includes a tilt device for measuring a tilt of the railroad gate and a controller coupled to the tilt device. The controller is selectively operable in a calibration mode and a monitoring mode. In the calibration mode, the controller measures a predetermined tilt of the railroad gate. In the monitoring mode, the controller measures a current tilt of the railroad gate to determine deviations between the current tilt and the predetermined tilt.

13 Claims, 7 Drawing Sheets

METHODS AND SYSTEMS FOR VERIFYING THE OPERATION OF A RAILROAD GATE

BACKGROUND OF THE INVENTION

The present invention relates to railroad systems, and more particularly, to methods and systems for use in aligning railroad gates.

Railroad gates are generally positioned adjacent to railroads and are configured to substantially block access to a railroad from an intersecting roadway. Specifically, railroad gates are used to warn drivers of vehicles and/or pedestrians of an oncoming train, and to prevent the drivers and pedestrians from crossing the railroad while an oncoming train passes. Typically, the railroad gate includes a moveable member that is pivotably coupled to a stationary support member. When an oncoming train is approaching an intersection, the moveable member is pivoted into a position across the roadway that substantially blocks the intersection. When the intersection is clear of passing and oncoming trains, the moveable member is pivoted upward to a stored position that allows access through the intersection.

The effectiveness of railroad gates depends on various factors, including the alignment of the gates. For example, a misaligned railroad gate may fail to adequately block an intersection, thereby creating a safety hazard. Such misalignment of a railroad gate may arise from several causes, such as, but not limited to, being struck by a passing train, being struck by a passing vehicle, being misaligned as a result of the weather, and/or through vandalism. Accordingly, current regulations require that a maintenance worker regularly travel to railroad gates to manually verify the operation and alignment of the gate. In some cases, the railroad gates are located in remote locations, and as such, the process of manually checking each gate may be a costly, inefficient, and/or time-consuming process.

BRIEF DESCRIPTION OF THE INVENTION

In one embodiment, a system for verifying the operation of a railroad gate is provided. The system includes a tilt device for measuring a tilt of the railroad gate and a controller coupled to the tilt device. The controller is selectively operable in a calibration mode and a monitoring mode. In the calibration mode, the controller measures a predetermined tilt of the railroad gate. In the monitoring mode, the controller measures a current tilt of the railroad gate to determine deviations between the current tilt and the predetermined tilt.

In another embodiment, a method for verifying the operation of a railroad gate is provided. The method includes measuring a predetermined tilt of the railroad gate, monitoring a current tilt of the railroad gate, and determining deviations between the current tilt and the predetermined tilt.

In yet another embodiment, a railroad gate assembly is provided. The assembly includes a railroad gate and a processor. The processor is configured to measure a predetermined tilt and a predetermined direction of the railroad gate, monitor a current tilt and a current direction of the railroad gate, and determine deviations between at least one of the current tilt and the predetermined tilt, and between the current direction and the predetermined direction.

DETAILED DESCRIPTION OF THE INVENTION

Figure 1:
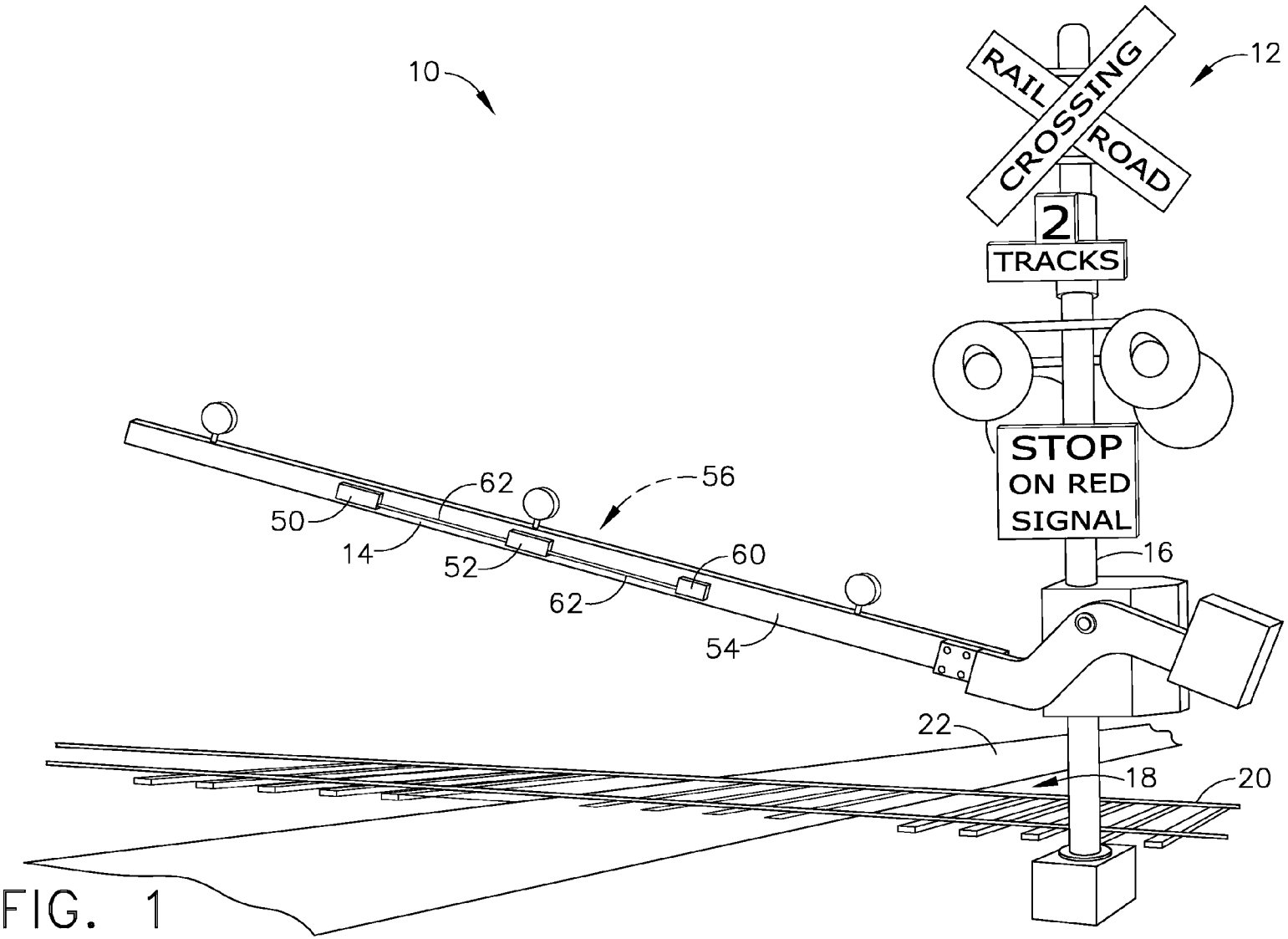
FIG. 1 is a perspective view of an exemplary system used to verify the alignment of a railroad gate.
Figure 2:
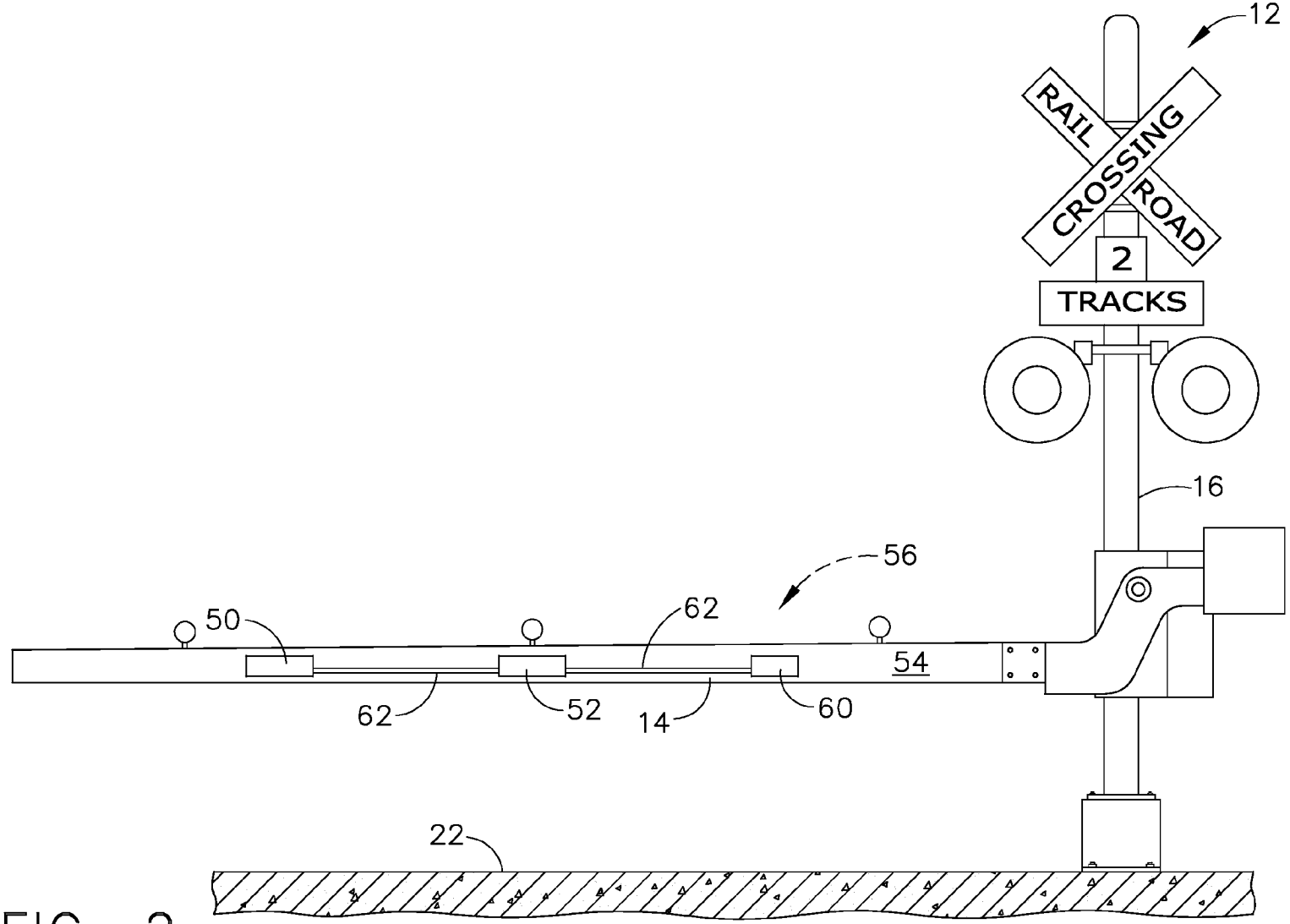
FIG. 2 is a front view of the railroad gate and alignment system shown in FIG. 1.
Figure 3:
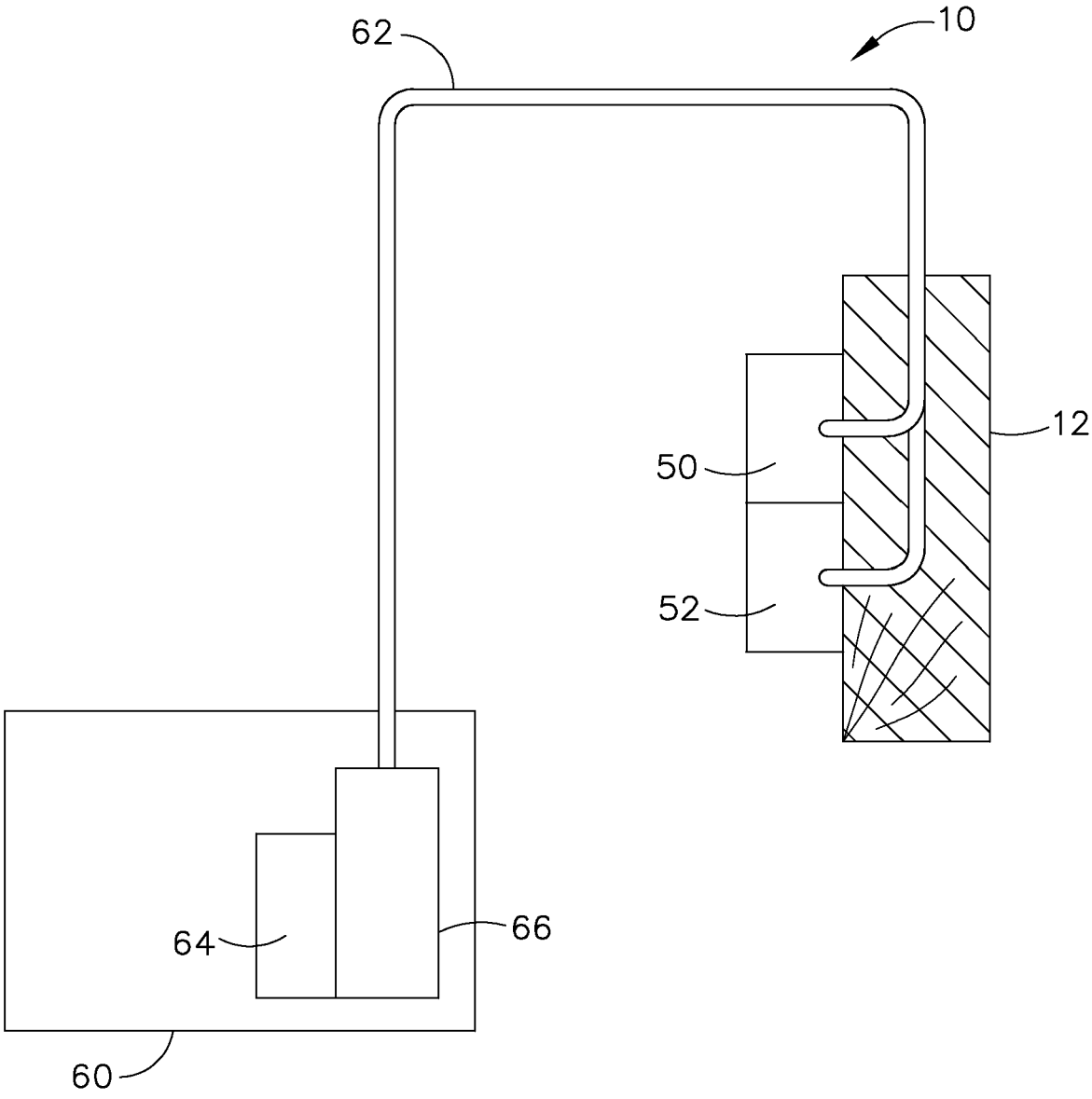
FIG. 3 is a cross-sectional schematic side view of a portion of the system shown in FIG. 1.

FIG. 1 is a perspective view an exemplary embodiment of a system 10 used to verify the alignment of a railroad gate 12. FIG. 2 is a front view of system 10. FIG. 3 is a cross-sectional schematic side view of a portion of system 10. In the exemplary embodiment, gate 12 includes a member 14 that is pivotably coupled to a stationary support member 16. Gate 12 is configured to warn drivers and pedestrians of an oncoming train and to prevent drivers and pedestrians from crossing a railroad 18 while a train is passing an intersection 20 adjacent to gate 12. In the exemplary embodiment, intersection 20 is defined by railroad 18 and a roadway 22. In an alternative embodiment, intersection 20 is defined by railroad 18 and any other pathway, for example, a pedestrian pathway. In the exemplary embodiment, member 14 is configured to be pivotable into a position extending across roadway 22 to facilitate blocking intersection 20, when an oncoming train is approaching and/or a train is passing intersection 20. Moreover, in the exemplary embodiment, member 14 is pivotable upward to allow drivers and pedestrians to pass through intersection 20, when intersection 20 is clear of trains and no oncoming trains are imminent.

In the exemplary embodiment, as described herein, an orientation of gate 12 is adjustable with respect to both railroad 18 and roadway 22. More specifically, in the exemplary embodiment, system 10 includes a tilt device 50 to measure a tilt $\theta$ of gate 12 with respect to roadway 22 and a directional device 52 to measure a directional variance $\Phi$ of gate 12 with respect to roadway 22. Although the exemplary embodiment illustrates both tilt device 50 and directional device 52, as will be appreciated by one of ordinary skill in the art, in one embodiment, system 10 includes only a tilt device 50 to measure the tilt $\theta$ of gate 12 with respect to roadway 22. Moreover, in another embodiment, system 10 includes only a directional device 52 to measure a directional variance $\Phi$ of gate 12 with respect to roadway 22. In the exemplary embodiment, tilt device 50 includes any device capable of measuring the tilt $\theta$ of gate 12, such as an accelerometer. Specifically, in one embodiment, a 3-axis DC-coupled accelerometer is used to measure the tilt $\theta$ of gate 12. In another embodiment, tilt device 50 is a low-g accelerometer. Although the exemplary embodiment illustrates tilt device 50 as being coupled to member 14, as will be appreciated by one of ordinary skill in the art, system 10 can be modified to function as described herein. As such, in other embodiments, tilt device 50 can be coupled to other components such as, but not limited to, support member 16 and/or member 14. Moreover, tilt device 50 may be coupled at any location along a front surface 54 or a rear surface 56 of member 14. For example, in one embodiment, tilt device 50 is coupled to an end 58 of member 14. Moreover, although the exemplary embodiment illustrates only a single tilt device 50 coupled to member 14, as will be appreciated by one of ordinary skill in the art, system 10 can be modified to include a plurality of tilt devices 50.

In addition, in the exemplary embodiment, directional device 52 includes any device capable of measuring the directional variance Φ of the gate 12, such as, but not limited to, a compass. Specifically, in one embodiment, an electronic compass is used to measure the directional variance Φ of gate 12. Although the exemplary embodiment illustrates directional device 52 as being coupled to member 14, as will be appreciated by one of ordinary skill in the art, system 10 can be modified to function as described herein. As such, in other embodiments, directional device 52 can be coupled to other components such as, but not limited to, support member 16 and/or member 14. Moreover, directional device 52 may be coupled at any location along a front surface 54 or a rear surface 56 of member 14. Moreover, although the exemplary embodiment illustrates only a single directional device 52 coupled to member 14, as will be appreciated by one of ordinary skill in the art, system 10 can be modified to include a plurality of directional devices 52.

In the exemplary embodiment, system 10 also includes a controller 60 that is coupled to tilt device 50 and to directional device 52. Controller 60 is configured to monitor tilt device 50 and directional device 52. In one embodiment, controller 60 is a HAWK®. In the exemplary embodiment, controller 60 is coupled to devices 50 and 52 via a wire coupling 62 that accommodates the transmission of data, as described herein. In an alternative embodiment, tilt device 50 and directional device 52 are wirelessly coupled to controller 60 via transceivers or any other wireless communication device that enables system 10 to function as described herein. Although in the exemplary embodiment, controller 60 is coupled to member 14, as will be appreciated by one of ordinary skill in the art, controller 60 can be coupled to support member 16 and/or to member 14. Moreover, in the exemplary embodiment, controller 60 may be positioned at any location along a front surface 54 or a rear surface 56 of member 14. In another embodiment, controller 60 may be remotely located and configured to communicate with tilt device 50 and directional device 52 via a wireless network. Additionally, although the exemplary embodiment illustrates only a single controller 60 coupled to tilt device 50 and to directional device 52, an individual controller 60 may be coupled to each of tilt device 50 and directional device 52.

In the exemplary embodiment, each controller 60 is selectively operable in a calibration mode and a monitoring mode. Controller 60 is operable in either mode using a switch controlled by an operator performing an on-site functionality test of system 10 when an alignment check of gate 12 is performed, or controller 60 may be selectively operable between the modes remotely, using an automatic switch when an alignment check of gate 12 is performed. In the exemplary embodiment, controller 60 includes a memory device 64 and an error detection filter 66.

Figure 4:
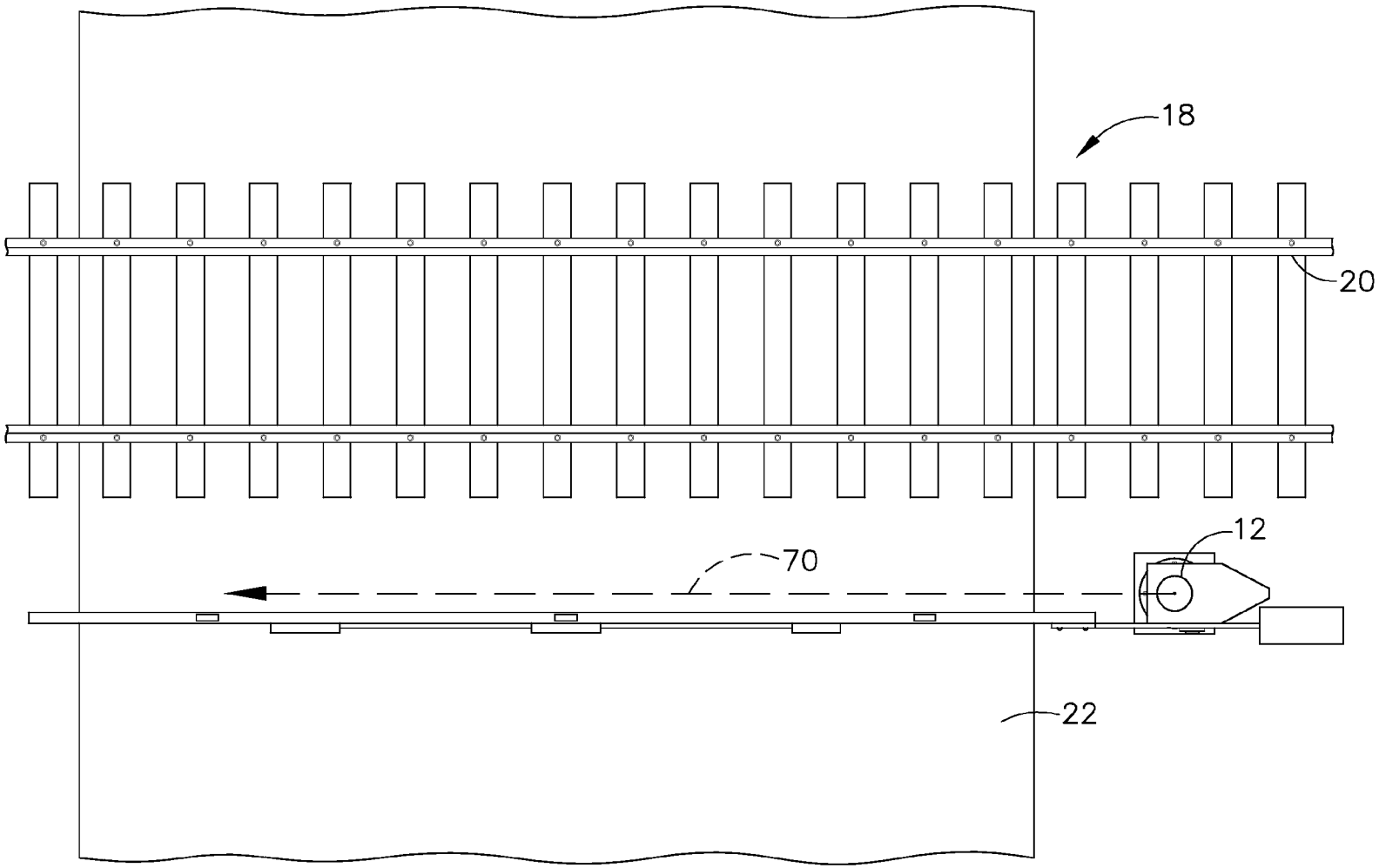
FIG. 4 is a top view of the system shown in FIG. 1 wherein the railroad gate is properly aligned with respect to a roadway intersecting the railroad.
Figure 5:
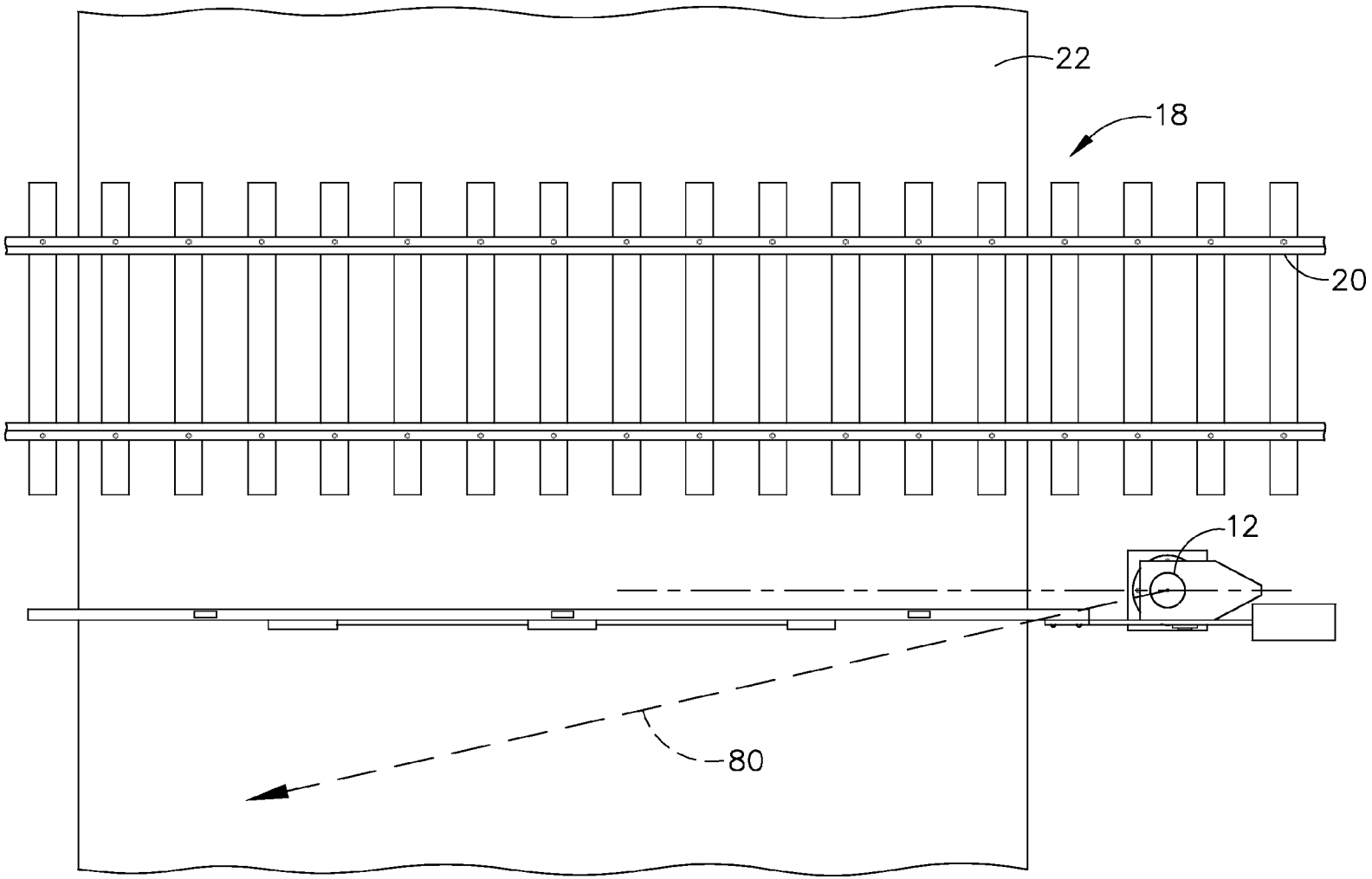
FIG. 5 is a top view of the system shown in FIG. 1 wherein the railroad gate is misaligned with respect to a roadway intersecting the railroad.
Figure 6:
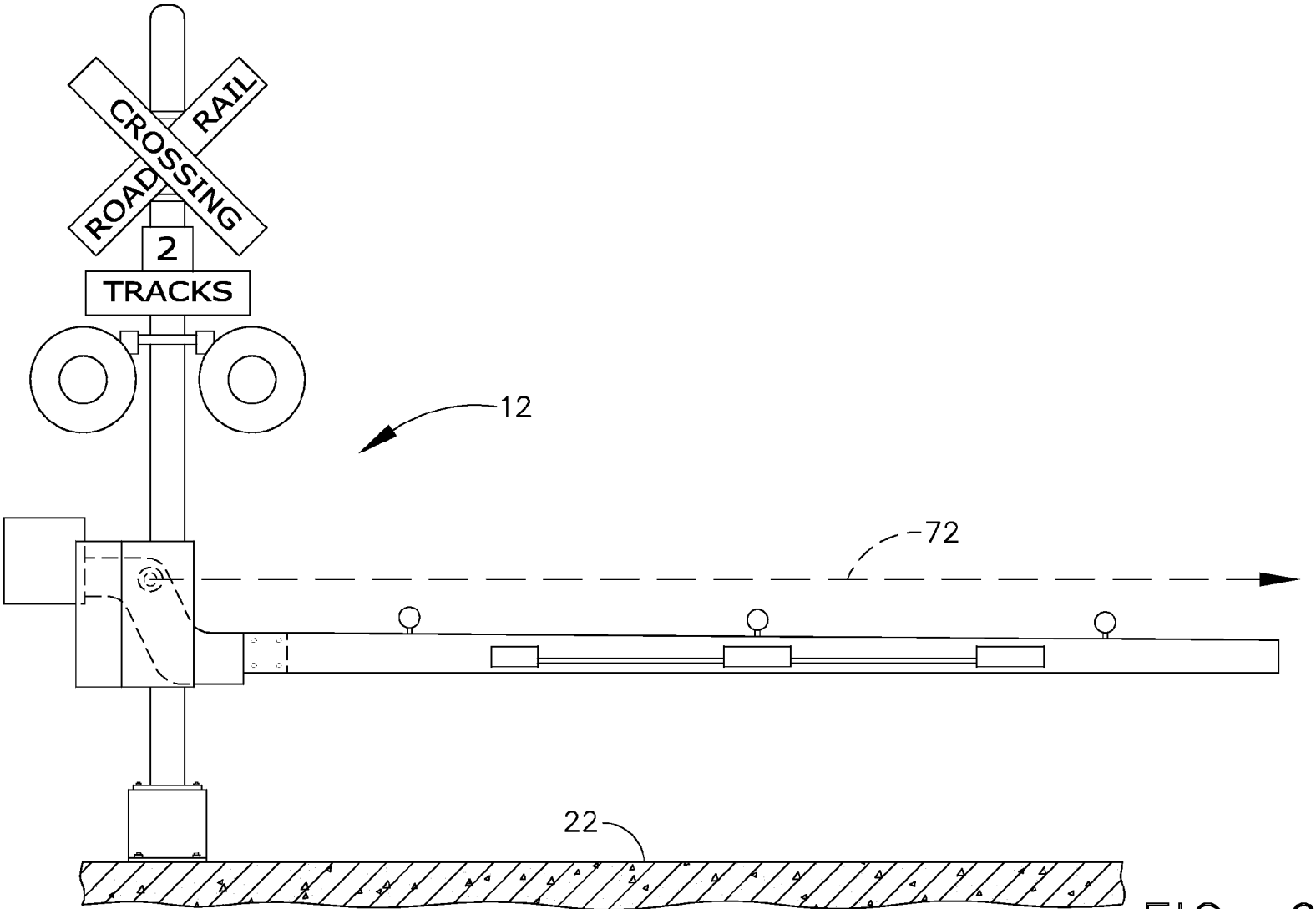
FIG. 6 is a side view of the system shown in FIG. 1 wherein the railroad gate is properly aligned with respect to a roadway intersecting the railroad.
Figure 7:
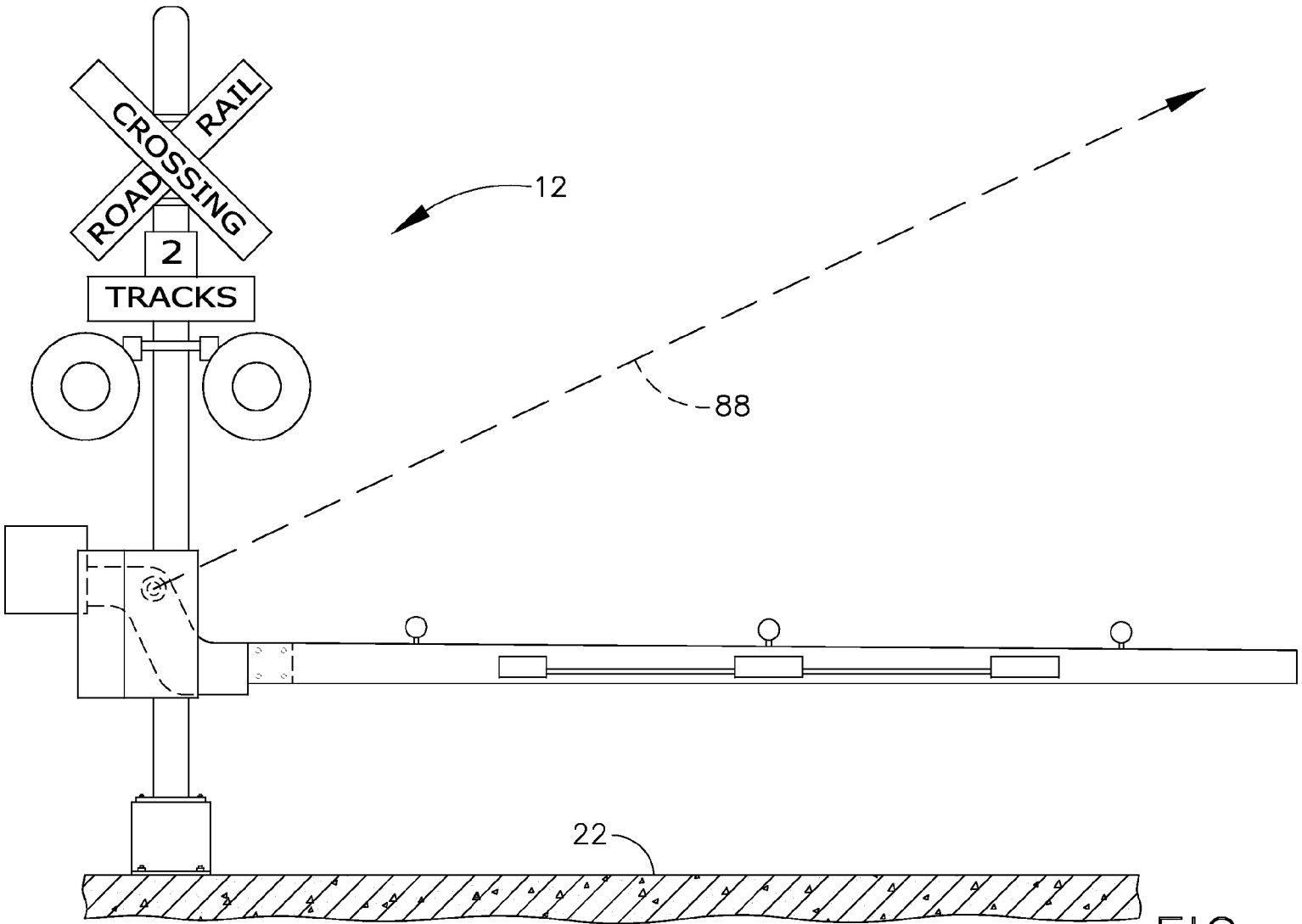
FIG. 7 is a side view of the system shown in FIG. 1 wherein the railroad gate is misaligned with respect to a roadway intersecting the railroad.

FIG. 4 is a top view of system 10, wherein the directional variance Φ of gate 12 is substantially aligned with respect to roadway 22. FIG. 5 is a top view of system 10, wherein the directional variance Φ of gate 12 is misaligned with respect to roadway 22. FIG. 6 is a side view of system 10, wherein the tilt θ of gate 12 is substantially aligned with respect to roadway 22. FIG. 7 is a side view of system 10, wherein the tilt θ of gate 12 is misaligned with respect to roadway 22. When operated in the calibration mode, gate 12 is aligned in a predetermined alignment for safe operation.

Specifically, in the exemplary embodiment, when gate 12 is properly aligned, gate 12 is aligned substantially perpendicular to roadway 22 such that vehicle drivers and/or pedestrians on roadway 22 are prevented from crossing railroad 18. More specifically, when gate 12 is properly aligned, gate 12 may be parallel to railroad 18, perpendicular to roadway 22, or at any orientation that enables gate 12 to substantially prevent vehicles and/or pedestrians from crossing through intersection 20 and across railroad 18. Specifically, gate 12 is aligned with a predetermined direction 70 with respect to at least one of railroad 18 and roadway 22, as shown in FIG. 4, and a predetermined tilt 72 with respect to a plane of roadway 22, as shown in FIG. 6.

After gate 12 is aligned in a proper alignment at predetermined direction 70 and predetermined tilt 72, tilt device 50 and directional device 52 respectively measure directional variance Φ and tilt θ, and communicate them to memory device 64. In the exemplary embodiment, the directional variance Φ of predetermined direction 70 is recorded in memory device 64 using an angular direction, and the tilt θ of predetermined tilt 72 is recorded in memory device 64 using three vector components and including the gravitational force induced on gate 12 in each of the three dimensions.

After predetermined direction 70 and predetermined tilt 72 are recorded in memory device 64, controller 60 is then operable in the monitoring mode. In the monitoring mode, controller 60 samples a current direction 80 and a current tilt 88 of gate 12 using directional device 52 and tilt device 50, when gate 12 is operated. In one embodiment, controller 60 obtains the current tilt data and the current direction data of gate 12 at an adjustable sample rate.

For each current tilt 88 and current direction 80 communicated from the tilt device 50 and directional device 52 to the controller 60, controller 60 determines if either the current tilt 88 and/or current direction 80 of gate 12 exceeds a respective predetermined tilt threshold and/or a predetermined direction threshold that are based on the predetermined tilt 72 and the predetermined direction 70 stored in memory device 64 of controller 60. To determine if current tilt 88 and/or current direction 80 of gate 12 exceeds a respective tilt threshold and/or a direction threshold, controller 60 detects the presence of a mean shift over a time duration of one of the tilt θ and/or the directional variance Φ of gate 12. In the exemplary embodiment, controller 60 detects the tilt mean shift over a time duration, including a determination of whether a shift of the tilt vector mean of gate 12 in three dimensions, as measured, is beyond the respective three dimensions of the tilt threshold. Moreover, in the exemplary embodiment, the determination of a directional mean shift over a time duration also includes the determination of a shift of the vector mean of the angular direction of gate 12, as measured, beyond a respective angular direction threshold. In detecting the presence of a mean shift over a time duration of one of tilt and direction, controller 60 negates transient vibrations of gate 12 during the time duration. The time duration is thus selected to be long enough to avoid consideration of such transient vibrations, yet short enough to provide meaningful calculations of each tilt and direction mean at each time.

In the exemplary embodiment, after controller 60 is operating in the monitoring mode, controller 60 may determine if either the current tilt 88 and/or the current direction 80 of gate 12 exceeds a respective tilt threshold and direction threshold. As described herein, the aforementioned determination is made after the current tilt data and current direction data have been collected, transmitted through error detection filter 66 and compared to respective tilt and direction thresholds. After detecting that either the current tilt 88 or the current direction 80 of gate 12 exceeds a respective tilt threshold and/or direction threshold, controller 60 switches from the monitoring mode into an alert mode.

For example, as is illustrated in FIG. 4, in the exemplary embodiment, controller 60 is initially switched to the calibration mode and railroad gate 12 is rotated to a predetermined direction 70 along railroad 18. In the exemplary embodiment, as is illustrated in FIG. 5, gate 12 may undesirably rotate beyond the direction threshold and become misaligned due to a number of reasons including, but not limited to, contact with a passing locomotive, contact with passing automobiles and trucks, and/or vandalism. Accordingly, directional device 52 measures the current direction 80 of railroad gate 12 and communicates current direction data to controller 60. In the exemplary embodiment, through the comparative process described herein, if controller 60 detects that the mean of the railroad gate direction has shifted beyond the direction threshold, controller 60 switches from the monitoring mode to the alert mode to indicate that railroad gate 12 has rotated beyond the direction threshold.

In another example, as is illustrated in FIG. 6, controller 60 is initially switched to the calibration mode and railroad gate 12 is rotated to a predetermined tilt 72 with respect to roadway 22. In the exemplary embodiment, as is illustrated in FIG. 7, gate 12 may undesirably rotate beyond the tilt threshold and become misaligned due to a number of reasons including, but not limited to, contact with a passing locomotive, contact with passing automobiles and trucks, and/or vandalism. Accordingly, tilt device 50 measures the current tilt 88 of railroad gate 12 and communicates the current tilt data to controller 60. In the exemplary embodiment, when controller 60 detects that the mean of the railroad gate tilt has shifted beyond the tilt threshold, controller 60 switches from the monitoring mode to the alert mode to indicate that railroad gate 12 has rotated beyond the tilt threshold. As such, in the exemplary embodiment, controller 60 can detect a shift beyond the direction threshold, a shift beyond the tilt threshold, or a shift beyond both the direction and the tilt threshold.

In the exemplary embodiment, after controller 60 has switched to the alert mode, an alert signal is transmitted to a remote terminal to request realignment of gate 12 to the proper alignment with predetermined direction 70 and predetermined tilt 72. In one embodiment, the remote terminal may receive signals wirelessly via transceivers positioned on controller 60. Alternatively, the alert signal may be transmitted via any other method of communication that enables system 10 to function as described herein. In the exemplary embodiment, after receiving an alert signal, the remote terminal may schedule a maintenance worker to realign the gate 12.

In one embodiment, either controller 60, tilt device 50, and/or directional device 52 is electrically coupled to, and powered by, a light source (not shown) coupled to member 14. In another embodiment, at least one of controller 60, tilt device 50, and directional device 52 is electrically coupled to, and powered by, a self power generator (not shown) that is powered by the movement of member 14. As will be appreciated by one of ordinary skill in the art, in an alternative embodiment, controller 60, tilt device 50, and directional device 52 are electrically coupled to, and powered by, any suitable power source.

In one embodiment, a method for verifying the operation of a railroad gate is provided. The method includes measuring a predetermined tilt and a predetermined direction of the railroad gate, monitoring a current tilt and a current direction of the railroad gate, and determining deviations between at least one of the current tilt and the predetermined tilt, and between the current direction and the predetermined direction. In one embodiment, current tilt of the railroad gate is monitored with an accelerometer that monitors three vector components of the gravitational pull on the railroad gate, and the current direction of the railroad gate is monitored with a compass that monitors the angular direction of the railroad gate.

In one embodiment, determining deviations between at least one of the current tilt and the predetermined tilt, and between the current direction and the predetermined direction includes detecting a mean shift in at least one of the current tilt and the current direction over time. Further, in one embodiment, determining deviations between at least one of the current tilt and the predetermined tilt, and between the current direction and the predetermined direction includes filtering data associated with the current tilt and the current direction with an error detection filter.

In the exemplary embodiment, the method also includes transmitting an alert signal based on deviations between at least one of the current tilt and the predetermined tilt, and between the current direction and the predetermined direction. Further, in the exemplary embodiment, transmitting an alert signal includes transmitting an alert signal to a remote terminal. Moreover, in one embodiment, the method also includes powering at least one of the controller and the tilt device with a light source that is coupled to the railroad gate.

In the exemplary embodiment, system 10 also includes a processor that is programmed to operate system 10 as described herein. For example, system 10 may include, but is not limited to including, a microprocessor, microcontroller, a microcomputer, a programmable logic controller, an application specific integrated circuit, or any other programmable circuit. Therefore, the term processor, as used herein, is not limited to just those integrated circuits referred to in the art as computers, but broadly refers to microprocessors, microcontrollers, microcomputers, programmable logic controllers, application specific integrated circuits, and other programmable circuits, and these terms are used interchangeably herein.

As will be appreciated by one skilled in the art and based on the foregoing specification, the above-described embodiments of the invention may be implemented using computer programming or engineering techniques including computer software, firmware, hardware or any combination or subset thereof, wherein the technical effect is to align a railroad gate. Any such resulting program, having computer-readable code means, may be embodied or provided within one or more computer-readable media, thereby making a computer program product, i.e., an article of manufacture, according to the discussed embodiments of the invention. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

The above-described methods and systems enable automatic monitoring of a railroad gate to determine whether the gate is functioning properly or has shifted out of position. Accordingly, the need for regular manual inspection of the gate is eliminated, thereby facilitating a reduction in costs and/or time associated with maintenance of the railroad gate.

Exemplary embodiments of systems and methods for aligning a railroad gate are described above in detail. The systems and methods illustrated are not limited to the specific embodiments described herein, but rather, components of the system may be utilized independently and separately from other components described herein. Further, steps described in the method may be utilized independently and separately from other steps described herein.

While the invention has been described in terms of various specific embodiments, those skilled in the art will recognize that the invention can be practiced with modification within the spirit and scope of the claims.

What is claimed is:

1. A system for verifying the operation of a railroad gate, said system comprising:

a tilt device for measuring a tilt of the railroad gate;

a controller coupled to said tilt device, said controller selectively operable in a calibration mode and a monitoring mode, such that when said controller is in the calibration mode, said controller measures a predetermined tilt of the railroad gate, and when said controller is in the monitoring mode, said controller measures a current tilt of the railroad gate to determine deviations between the current tilt and the predetermined tilt; and a compass that measures an angular direction of the railroad gate, said controller coupled to said compass, such that when said controller is in the calibration mode, said controller measures a predetermined direction of the railroad gate, and when said controller is in the monitoring mode, said controller measures a current direction of the railroad gate to determine deviations between the current direction and the predetermined direction.

2. A system in accordance with claim 1 wherein said tilt device comprises an accelerometer that measures an amount of gravitational pull on the railroad gate.

3. A system in accordance with claim 1 wherein said controller determines deviations between the current tilt and the predetermined tilt by detecting a mean shift in the current tilt over time.

4. A system in accordance with claim 1 wherein said controller is further operable in an alert mode based on the determined deviations between the current tilt and the predetermined tilt.

5. A method for verifying the operation of a railroad gate, said method comprising:

measuring a predetermined tilt of the railroad gate during a calibrate mode;

monitoring a current tilt of the railroad gate during a monitoring mode different than the calibrate mode; and determining deviations between the current tilt and the predetermined tilt; and transmitting an alert signal based on deviations between at least one of the current tilt and the predetermined tilt.

6. A method in accordance with claim 5 further comprising:

measuring a predetermined direction of the railroad gate;

monitoring a current direction of the railroad gate; and determining deviations between the current direction and the predetermined direction.

7. A method in accordance with claim 6 wherein monitoring a current direction of the railroad gate further comprises monitoring an angular direction of the railroad gate with a compass.

8. A method in accordance with claim 5 wherein monitoring a current tilt of the railroad gate further comprises monitoring an amount of gravitational pull on the railroad gate with an accelerometer.

9. A method in accordance with claim 5 wherein said determining deviations between the current tilt and the predetermined tilt further comprises detecting a mean shift in the current tilt over time.

10. A railroad gate assembly comprising:

a railroad gate; and a processor configured to:

measure a predetermined tilt and a predetermined direction of the railroad gate during a calibrate mode, monitor a current tilt and a current direction of the railroad gate, filter data associated with the current tilt and the current direction with an error detection filter, and determine deviations between at least one of the current tilt and the predetermined tilt, and between the current direction and the predetermined direction.

11. A railroad gate assembly in accordance with claim 10 wherein said processor is further configured to:

monitor the current tilt of the railroad gate by monitoring an amount of gravitational pull on the railroad gate with an accelerometer, and monitor the current direction of the railroad gate by monitoring an angular direction of the railroad gate with a compass.

12. A railroad gate assembly in accordance with claim 10 wherein said processor is further configured to detect a mean shift in at least one of the current tilt and the current direction over time.

13. A railroad gate assembly in accordance with claim 10 wherein said processor is further configured to transmit an alert signal based on deviations between at least one of the current tilt and the predetermined tilt, and between the current direction and the predetermined direction.

* * * * *